US005370396A

United States Patent [19]

Bloom

[11] Patent Number: 5,370,396

[45] Date of Patent: Dec. 6, 1994

[54] PIVOTING GOLF CLUB

[76] Inventor: Raymond L. Bloom, 4961 326th Ave. NE., Carnation, Wash. 98014

[21] Appl. No.: 138,957

[22] Filed: Oct. 19, 1993

[51] Int. Cl.[5] ..... A63B 69/36

[52] U.S. Cl. ..... 273/186.2; 273/193 B

[58] Field of Search ..... 273/193 B, 186.2, 186.3, 273/187.4

[56] References Cited

U.S. PATENT DOCUMENTS

| | | | |
|---|---|---|---|
| 2,497,237 | 2/1950 | Reineking | 273/80 |
| 3,033,575 | 5/1962 | Hause | 273/193 B |
| 4,854,585 | 8/1989 | Koch et al. | 273/193 B |
| 4,856,782 | 8/1989 | Cannan | 273/80 B |

FOREIGN PATENT DOCUMENTS

| | | | |
|---|---|---|---|
| 2258157 | 2/1993 | United Kingdom | 273/193 B |

*Primary Examiner*—George J. Marlo

*Attorney, Agent, or Firm*—Craine & Jackson

[57] ABSTRACT

Disclosed herein is an improved golf club having an improved one-way hinge which is more durable than hinges used on typical hinged golf clubs. The hinged golf club includes a tubular shaft divided into an upper and lower sections with the improved hinge disposed therebetween. The hinge includes a pair of female and male hinge members pivotally connected together with a transversely aligned pin. Attached over the hinge members is an outer sleeve with acts to keep the hinge members in continuous alignment. The outer sleeve also has a stop surface prevents movement of lower section of the shaft in one direction beyond the longitudinally aligned position. The hinge also includes an optional pair of spring washers disposed on the pin and between the adjacent surfaces of the female and male hinge members which act to provide resistance to pivoting movement.

5 Claims, 3 Drawing Sheets

PIVOTING GOLF CLUB

BACKGROUND OF THE INVENTION

1. Field of the Invention

This invention relates to practice golf clubs and, more particularly to practice golf clubs having a hinge manufactured in the shaft.

2. Description of the Related Art

One or two-way hinge golf clubs have been developed in the past to improve a golfer's golf swing. With such clubs, a hinge is manufactured in the shaft which allows the lower section of the shaft to pivot relative to the upper section when the golf club is improperly swung. Centrifugal forces exerted on the upper and lower sections of the shaft during an improperly executed swing causes the sections to pivot at the hinge. By monitoring if and when the upper and lower sections pivot during the swing, one can determine whether the swing is properly executed.

One or two-way hinge golf clubs have been developed as disclosed in U.S. Pat. Nos. 2,497,237, 3,033,575, 4,854,585 and 4,856,782. One problem with two-way hinge golf clubs which allow the upper and lower sections of the shaft to pivot in the forward or rearward direction, is that they are difficult to use as instructional aids.

One problem with all types of hinge golf club developed heretofore is that manufacturing, tolerances of the individual hinge members must be very relatively small so that hinge operates correctly. Such small tolerance requirements, of course, lead to increased manufacturing costs. For example with many hinged golf clubs, the hinge members must be properly manufactured so that the upper and lower sections of the shaft always return to a longitudinally aligned position during use. Also, the hinge members must fit together tightly so that the hinge does not wobble or pivot to freely during use. If the hinge pivots too "freely", small external forces, such as gravity and wind, exerted on the upper and lower sections of the shaft or the clubhead, cause the sections to pivot thereby giving the user inaccurate information regarding his or her swing. Still another problem with such golf clubs is that with continuous use, adjacent surfaces in the adjoining hinge members become worn which causes additional "play" in the hinge.

Ideally, the hinged golf club should be lightweight with the hinge itself being made of the same material as the shaft of the golf club, namely stainless steel. One problem however with hinges made of stainless steel material, is that the rubbing surfaces become "galled" over a short period which may effect the pivoting action.

In summary, a one way hinge golf club is needed in which the hinge is made of stainless steel material that uses hinged members which can be manufactured with greater tolerance. Also, the hinged golf club must be sufficiently durable to withstand normal wear and tear forces so that excessive "play" does not develop with continuous use. Also the hinge must be designed so that the lower and upper sections of the shaft always return to a longitudinally aligned position. It is also desirable that the hinge have means to prevent undesirable pivoting when using either an opened or closed club head.

SUMMARY OF THE INVENTION

It is an object of the present invention to provide an improved hinged golf club which is used to improve a golfer's golf swing.

It is another object of the present invention to provide a hinged golf club that has a stainless steel hinge that is more durable than typical hinges used with hinged golf clubs developed heretofore.

It is a further object of the present invention to provide such a golf club in which the hinge has sufficient resistance to reduce the effects of gravity and wind on the shaft and clubhead during a golf swing.

These and other objects are met by providing a hinged golf club with an improved hinge. Disclosed herein is a hinged golf club having a tubular shaft divided into upper and lower shaft sections by a hinge. Attached to the upper section is a hand grip and attached to the lower section is a wood or metal club head.

The improved hinge includes female and male hinge members pivotally connected together by an interconnecting pivoting pin. The female hinge member includes a cylindrical shaped stem which is inserted and fitted into the distal end of the upper shaft member. The male hinge member also includes a cylindrical shaped stem which is inserted and fitted into the proximal end of the lower shaft member. During assembly, the downward extending portion of the female hinge member interconnects with the upward extending portion of the male hinge member with the traversely aligned pivoting pin.

Attached to the female hinge member is an outer sleeve which extends downward longitudinally over the hinge. The outer sleeve acts to keep the female and male hinge members in tight alignment and to reduce wobble or play therebetween. In addition, the outer sleeve has stop surfaces which limit the forward and rearward rotation of the lower shaft section. By placing stop surfaces on the outer sleeve rather that on the female or male hinge members, the durability of the hinge is improved. In the preferred embodiment, the female and male hinge members are made of stainless steel material to reduce rust.

To prevent galling of the stainless steel hinge members and to provide resistance thereto, the hinge also includes a pair of spring washers disposed around the pivoting pin and between the adjacent surfaces of the hinge members. The spring washers act as spacers between the adjacent surfaces. By providing resistance between the hinge members, pivotal movement of the hinge members caused by small external forces, such as gravity and wind, rather than the stronger centrifugal forces created during the swing, is prevented. The washers also provide sufficient resistance between the hinge members so that the clubhead may be aligned in either a closed or open position of the lower shaft.

DESCRIPTION OF THE PREFERRED EMBODIMENT(S)

Figure 1:
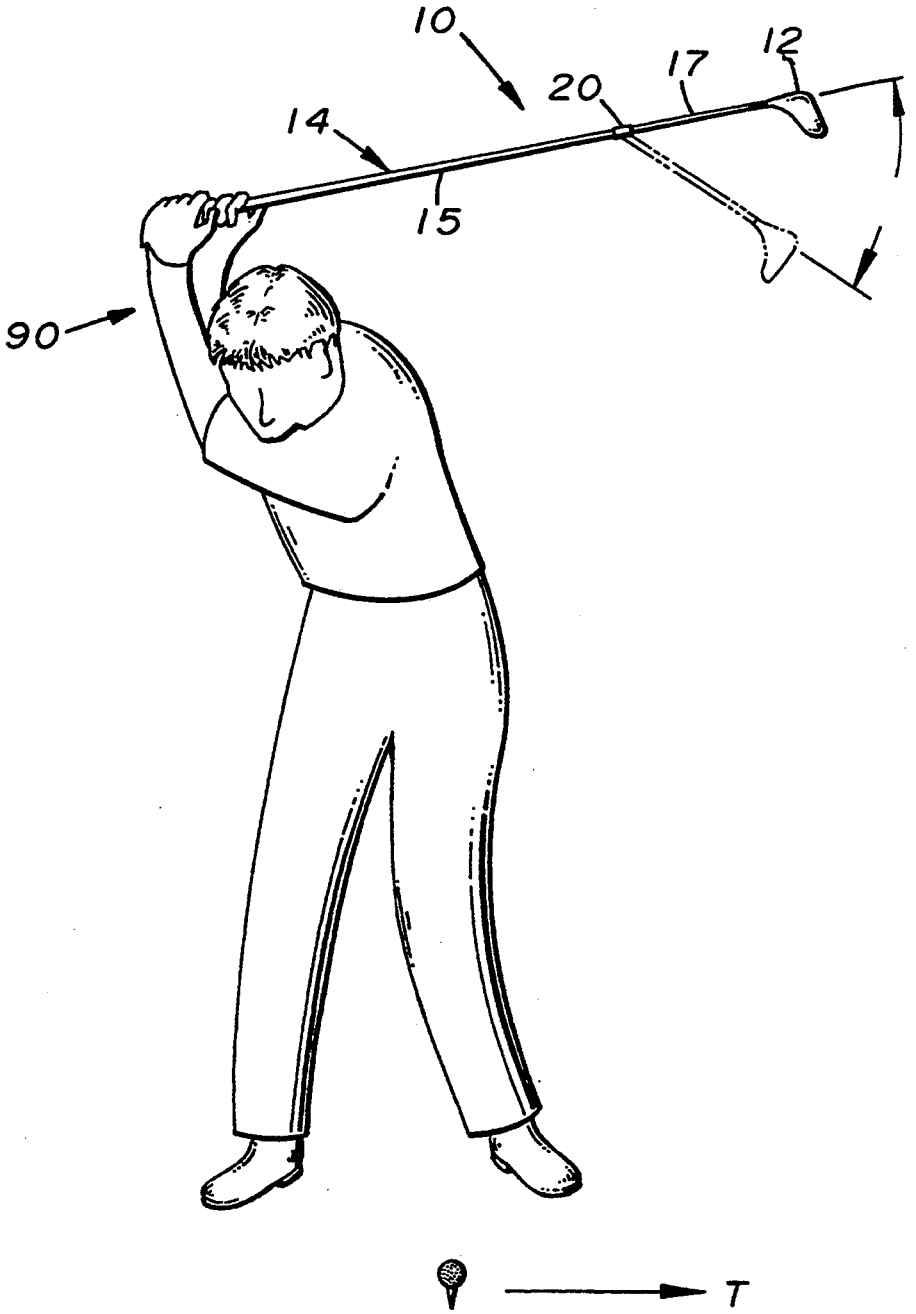
FIG. 1 is a perspective view of a right-handed golfer using the pivoting golf club described herein.

As shown in FIG. 1, there is disclosed herein a hinged golf club, generally indicated 10, used to improve a golfer's golf swing. The hinged golf club 10 includes a tubular shaft 160 divided into upper and lower shaft sections 15, 17 respectively, by an improved hinge 20. Attached to the upper shaft section 15 is a hand grip 11 and attached to the lower shaft section 17 is a wood or metal clubhead 12.

Figure 2:
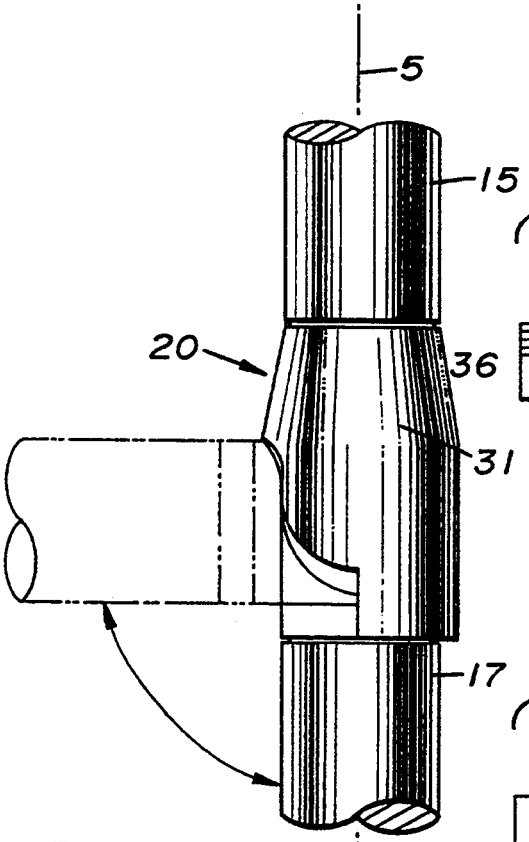
FIG. 2 is a front elevational view of the hinge as viewed when facing the golfer shown in FIG. 1 illustrating how the hinge enables the lower section to pivot upward in a clockwise direction with respect to the upper shaft section.

As shown more clearly in FIG. 2, the hinge 20 is designed to allow the lower shaft section 17 to pivot away from the longitudinally aligned position and the target line to a position substantially perpendicular to the longitudinal axis 5. The hinge 20 is aligned on the golf club so that when the golfer is properly aligned, the face of the club head (not shown) is substantially perpendicular to the target line, indicated "T".

The hinge 20 comprises a female hinge member 22 attached to the distal end of the upper shaft section 15 and a male hinge member 40 attached to the proximal end of the lower shaft section 17. As shown in FIGS. 3–16, the female hinge member 22 includes a downward extending receiver 24 and an outer sleeve 30 that extends longitudinally over the outside surface thereof. The receiver 24 is cylindrical in shape with an upper stem 25 designed to fit tightly into the distal end of the upper shaft section 15. The portion 24*b* of the receiver 24 that extends downward from the upper shaft section 15 has an interior longitudinally aligned recess 34 formed therein designed to receive the tongue member 46 manufactured on the male hinge member 40 described further below. A traversely aligned bore 32 is manufactured in the extended portion 24b which receives a pivoting pin 50.

Figure 5:
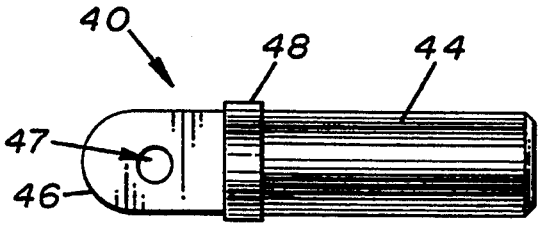
FIG. 5 is a front elevational view of the male hinge member.
Figure 6:
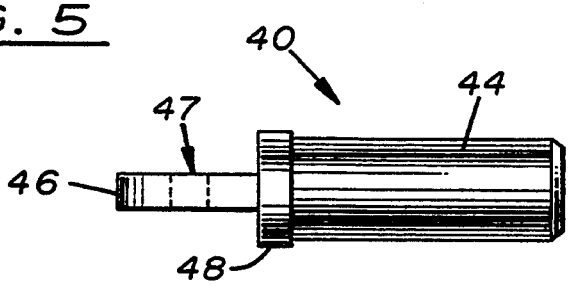
FIG. 6 is a side elevational view of the male hinge member shown in FIG. 5.

The male hinge member 40 includes an upward extending tongue member 46 and a lower stem 44 as shown in FIG. 5. The lower stem 44 is cylindrical in shape and is designed to fit tightly into the proximal end of the lower shaft section 17. The tongue member 46 is complimentary in shape and thickness with the recess 34 manufactured on the extending portion 26 of the female hinge member 22. A traversely aligned bore 47 is manufactured in the tongue member 46 with receives pivoting pin 50.

The female and male hinge members 22, 40, respectively, are pivotally connected together by extending and aligning the tongue member 46 in the recess 34 on the female hinge member 26 so that the bores 32 and 47 are registered. A pin 50 is then inserted therethrough to connect the hinge members 22, 40 together.

Figure 3:
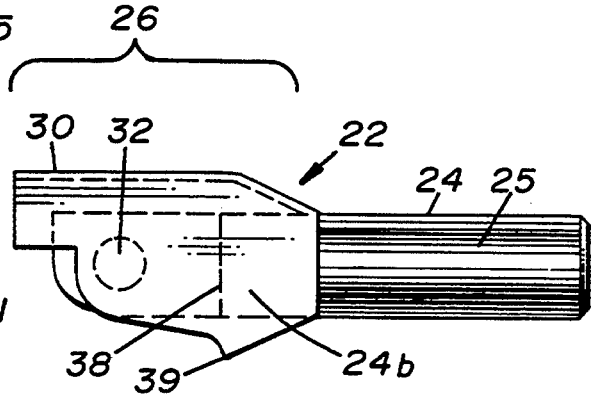
FIG. 3 is a rear elevational view of the female hinge member.
Figure 4:
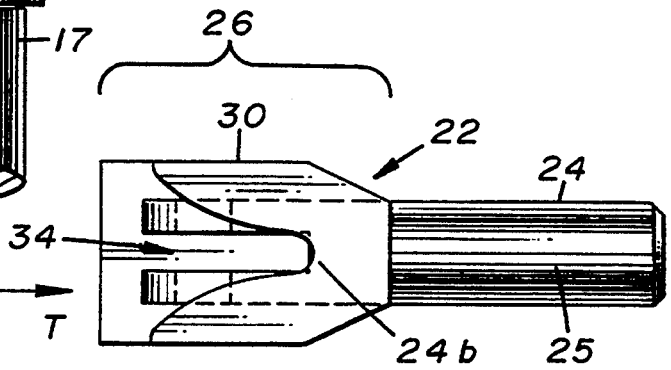
FIG. 4 is a side elevational view of the female hinge member shown in FIG. 3 as seen from a position parallel to the target line.

As mentioned above, the cylindrical shaped tubular outer sleeve 30 extends downward and covers the hinge 20. The upper section 31 of the outer sleeve 30 converges towards the receiver 24 on the female hinge member 26. As shown in FIGS. 2–4, the surface of the outer sleeve 30 facing away from the target line "T" is cut away to allow the lower shaft section 17 to pivot upward away from the target line "T". The front side facing the target line and the opposite sides of the outer sleeve 30 extend downward over the tongue member 46 to keep the hinge members 22, 40 longitudinally aligned and to reduce wobble or play therebetween. In the preferred embodiment, the hinge members 22, 40 and outer sleeve 30 are made of stainless steel material to reduce rust.

One problem with existing hinged golf clubs is that the stop surfaces on the touching surfaces of hinge members begin to wear with continuous use. In the invention disclosed herein, the outer sleeve 30 also acts as the means to control the forward and rearward pivotal movement of the upper and lower shaft sections 15, 17, respectively. In the preferred embodiment, forward interior wall 36 of the outer sleeve 30, shown in FIG. 3, acts as longitudinally aligned first stop surface to prevent movement of the lower shaft section 17 beyond the longitudinally aligned position. The upper perpendicular surface 38 of the recess space 34 and the outer tip 39 of the outer sleeve 30 acts as a traversely aligned second stop surface to prevent upward rotational movement of the lower shaft section 17 beyond approximately 90 degrees from the longitudinal axis of the shaft.

Figure 7:
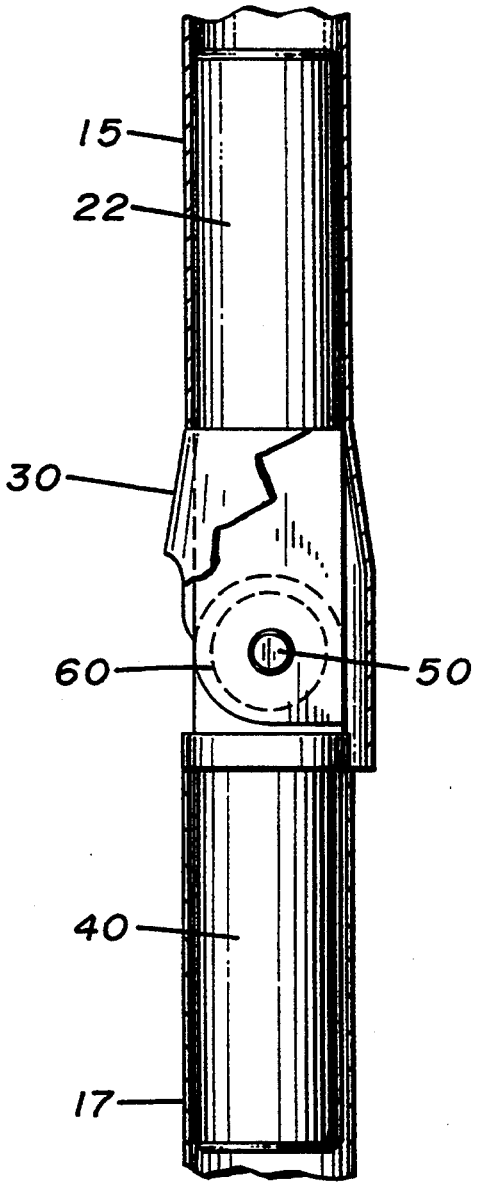
FIG. 7 is a front elevational view of the golf club similar to the view shown in FIG. 2, showing the hinge partially in section.
Figure 8:
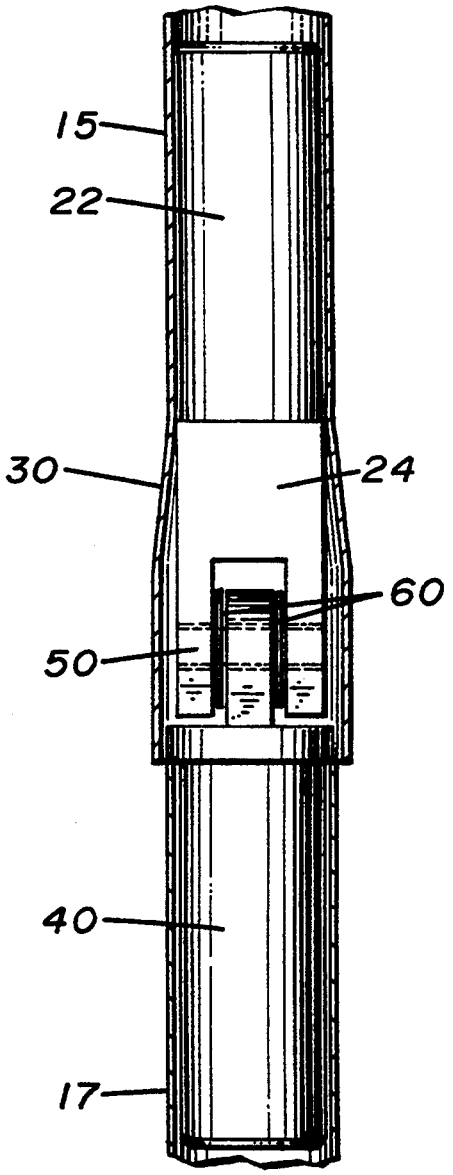
FIG. 8 is a side elevational view of the golf club as seen from a position parallel to the target line, showing the hinge partially in section.

As shown in FIGS. 7 and 8, located between the adjacent surfaces of the female and male hinge members 22, 40, respectively, is an optional pair of spring washers 60. The spring washers 60 act as spacers to reduce galling between the adjacent stainless steel surfaces of the hinge members 22, 40. In addition, the spring washers 60 act to provide small resistance between the hinge members 22 and 40 to prevent pivotal movement of the upper and lower shaft sections 15 and 17, respectively, caused by small forces, such as gravity and wind.

In compliance with the statute, the invention has been described in language more or less specific as to structural features. It should be understood, however, that the invention is not limited to the specific features shown since the means and construction shown comprises the preferred forms of putting the invention into effect. The invention is, therefore, claimed in any of its forms or modifications within the legitimate and valid scope of the amended claims, appropriately interpreted in accordance with the doctrine of equivalents.

I claim:

1. A pivoting golf club, comprising;

a. a golf club shaft, said shaft being divided into an upper section and a lower section, said lower section having a club head attached to the distal end thereof;

b. a one-way hinge disposed between said upper section and said lower section, said hinge including a female hinge member attached to said distal end of said upper section and a male hinge member attached to said proximal end of said lower section, said female hinge member and said male hinge member being connected together by a transversely aligned pivoting pin which enables said lower section to pivot relative to said upper section in a direction away from the target line, said hinge also includes a longitudinally aligned, tubular outer sleeve that extends downward over said female and said male hinge members to keep said female and said male hinge members aligned on said shaft, said outer sleeve also including a front surface partially cut-away which allows said upper and lower sections to pivot upward around said pivoting pin in a direction opposite to the target line up to approximately 90 degrees from said longitudinal axis of said shaft, said outer sleeve also includes a first stop surface which prevents said lower section from being rotated beyond a longitudinally aligned position and a second stop surface with prevents said upper section from being rotated upward more than approximately 90 degrees from said longitudinal axis of said shaft.

2. A pivoting golf club, as recited in claim 1, further including a resistance means disposed in said hinge to resist the pivotal movement of said upper and lower sections.

3. A pivoting golf club, as recited in claim 2, wherein said resistance means is a pair of spring washers located on said pivoting pin and disposed between said female and said male hinge members capable of providing frictional resistance therebetween.

4. A pivoting golf club, as recited in claim 3, wherein said female hinge member, said male hinge member, and said outer sleeve are made of stainless steel material.

5. A pivoting golf club, comprising:

a. a golf club shaft, said shaft being divided into an upper section and a lower section, said lower section having a club head attached to the distal end thereof;

b. a one-way hinge disposed between said upper section and said lower section, said hinge including a female hinge member attached to said distal end of said upper section and a male hinge member attached to said proximal end of said lower section, said female hinge member and said male hinge member being connected together by a transversely aligned pivoting pin which enables said lower section to pivot relative to said upper section in a direction away from the target line, said hinge also includes a longitudinally aligned outer sleeve that extends downward over said female and said male hinge members to keep said female and said male hinge members aligned on said shaft, said outer sleeve also including a front surface partially cut-away which allows said upper and lower sections to pivot upward around said pivoting pin in a direction opposite to the target line up to approximately 90 degrees from said longitudinal axis of said shaft, said outer sleeve also includes a first stop surface which prevents said lower section from being rotated beyond a longitudinally aligned position and a second stop surface with prevents said lower section from being rotated upward more than approximately 90 degrees from said longitudinal axis of said shaft, and;

c. a pair of spring washers located on said pivoting pin and disposed between the adjacent surface of said female and said male hinge members, said spring washers being capable of pivoting frictional resistance between said female and said male hinge members.

* * * * *